US008261706B2

(12) United States Patent
Weiss et al.

(10) Patent No.: US 8,261,706 B2
(45) Date of Patent: Sep. 11, 2012

(54) TIMING ADJUSTMENT DEVICE FOR AN INTERNAL COMBUSTION ENGINE

(75) Inventors: Michael Weiss, Aachen (DE); Rainer Ottersbach, Aurachtal (DE); Jochen Auchter, Gerhardshofen (DE); Rudolf Eydam, Geisfeld (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 248 days.

(21) Appl. No.: 12/674,496

(22) PCT Filed: Jul. 30, 2008

(86) PCT No.: PCT/EP2008/059992

§ 371 (c)(1),
(2), (4) Date: Apr. 26, 2010

(87) PCT Pub. No.: WO2009/027167

PCT Pub. Date: Mar. 5, 2009

(65) Prior Publication Data

US 2010/0199936 A1 Aug. 12, 2010

(30) Foreign Application Priority Data

Aug. 24, 2007 (DE) ..... 10 2007 040 017

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS

2003/0221647 A1 12/2003 Kobayashi et al.
2006/0278188 A1 12/2006 Payne et al.
2007/0039576 A1 2/2007 McCarthy et al.

FOREIGN PATENT DOCUMENTS

EP 1 310 634 XA 5/2003

*Primary Examiner* — Zelalem Eshete
(74) *Attorney, Agent, or Firm* — Lucas & Mercanti, LLP; Klaus P. Stoffel

(57) ABSTRACT

A timing adjustment device with axially joined components, clamped by a camshaft central screw on a hub element which maintains the required peripheral position of these components relative to one another within a narrow tolerance range. On a disk element of the timing adjustment device an insert section is formed, which can be inserted into a recess formed in the hub element and, in the region of the insert section, at least one anchoring structure is formed, through which the insert section is anchored on a counter-structure, which is provided by the hub element.

13 Claims, 5 Drawing Sheets

TIMING ADJUSTMENT DEVICE FOR AN INTERNAL COMBUSTION ENGINE

This application is a 371 of PCT/EP2008/059992 filed Jul. 30, 2008, which in turn claims the priority of DE 10 2007 040 017.0 filed Aug. 24, 2007, the priority of both applications is hereby claimed and both applications are incorporated by reference herein.

FIELD OF THE INVENTION

The invention relates to a timing adjustment device for an internal combustion engine which serves as such for adjusting the phase angle of the valve activation section of a valve drive, in particular of a camshaft, with respect to a drive train section which is mounted upstream in the power flux. In particular, the invention relates here to a timing adjustment device which is seated on a camshaft and by means of which the phase position of the camshaft can be changed with respect to a traction mechanism drive which is embodied as a control chain or toothed belt.

DE 10 2004 026 865 A1 discloses a timing adjustment device of the abovementioned type. This timing adjustment device comprises a hub element which is provided for mounting on an end journal section of a camshaft and an external housing which engages around the latter. This external housing is pivotable with respect to the hub element about an adjusting axis which is concentric to the axis of the camshaft, with the intermediate connection of an adjusting mechanism. The adjusting mechanism is embodied here as a vane cell mechanism having a plurality of adjusting cells, with the result that required pivoting of the external housing with respect to the hub element is achieved by correspondingly applying oil pressure to the adjusting cells of the vane cell mechanism. A chain wheel, which is in engagement with a control chain, is mounted on the external housing. The hub element is mounted on the end journal section of the camshaft by means of a central screw which has a head section, which is supported in a depression in the hub element, and a threaded section, which is anchored in the camshaft.

In particular in the case of timing adjustment devices of the abovementioned type, it is possible to clamp onto the hub element further components, in particular disk structures or pot structures which function as trigger wheels or restoring spring carriers, via the head section of the central screw on the hub element and to couple them to said hub element in a rotationally fixed fashion. Owing to the relatively large tightening torque which is typically necessary to secure the central screw, it is possible that, when the central screw is tightened, the trigger wheel, which is fitted onto the hub element, is slightly rotated. In order to prevent this rotation, it is known to secure the trigger wheel to the hub element by securing bolts.

OBJECT OF THE INVENTION

The invention is based on the object of disclosing solutions which make it possible, in a timing adjustment device with axially joined components which are clamped onto a hub element by a central screw of a camshaft, to reliably maintain the required circumferential positions of these components with respect to one another in a narrow tolerance range, in a way which is advantageous in terms of fabrication criteria.

This object is achieved according to the invention by means of a timing adjustment device for an internal combustion engine, having:

a hub element which has a seating region which is provided for fitting onto an end section of a camshaft, an external housing element which engages as such around the hub element and can be pivoted with respect to the hub element about a pivoting axis which is concentric with respect to the rotating axis of the camshaft, an adjusting mechanism for bringing about the pivoting of the external housing element with respect to the hub element, and a disk element which is clamped onto the hub element by means of the central screw of the camshaft, wherein this timing adjustment device is distinguished in that an insertion section, which can be inserted into a depression formed in the hub element, is formed on the disk element, and in that at least one anchoring structure, by means of which the insertion section is anchored to a corresponding structure which is made available by the hub element, is formed in the region of the insertion section.

This makes it advantageously possible for the disk element, which typically functions as a spring carrier, to be integrated in a highly secure fashion into the timing adjustment device within the scope of the fabrication of a timing adjustment device in such a way that the disk element is securely integrated into the corresponding assembly, and in addition is prevented from being unacceptably rotated within the scope of the connection of the timing adjustment device to an assigned camshaft.

According to one particularly preferred embodiment of the invention, the anchoring structure is embodied in such a way that it provides protection against axial movement of the disk element on the hub element. The anchoring structure is also embodied, preferably in combination with this measure, in such a way that said anchoring structure also provides protection against rotation.

The recess, which is designed to accommodate the insertion section of the disk element in the hub element, is preferably embodied as an essentially cylindrical or slightly conical depression or bore. The matching of the external dimension of the insertion section and the dimensioning of the internal diameter of this depression are preferably implemented in such a way that the insertion section is seated in the depression with a slight force fit.

According to one particular aspect of the present invention, the anchoring structure is preferably configured in such a way that it makes available a radially extending projection which is undercut in the extraction direction in conjunction with the corresponding engagement structure, which is made available by the hub element.

The anchoring structure may be fabricated by local plastic deformation of the insertion section. This local plastic deformation can be brought about, in particular, by means of suitable stamping elements which dip into the internal region of the insertion section within the scope of the assembly of the timing adjustment device. It is also possible to embody the anchoring structure in such a way that the anchoring structures which function as means for providing protection against extraction or rotation are formed by elastically deflectable sections of the disk element or of the insertion section thereof. In this respect, these elastically deflectable sections form, with at least one edge region, rear-engagement structures which latch on a corresponding corresponding wall of the hub element, which is made available, for example, by a groove. The structures, which are formed on the insertion section of the disk element in order to provide protection against rotation may be embodied, in particular, as web sections or lug sections which protrude radially in a sectional plane which is radial with respect to the axis of the camshaft.

The rear-engagement structure, which acts in order to provide the protection against extraction in the axial direction and, if appropriate, also offers protection against rotation, may also be embodied as a radially extending pawl, lug or claw.

The insertion section, which is arranged on the disk element, is, as already stated, preferably embodied as a pot structure. The rear-engagement structures which are integrally formed on this pot structure can, in particular, enter into engagement with the corresponding structures which are formed as a groove or pocket on the hub element. These engagement structures may, in particular, be fabricated by punching horse-shoe-shaped cutouts into the circumferential wall of the insertion section. The tongues which are formed in this way can be bent over toward the outside by a certain angle. When the insertion section of the disk element is inserted into the corresponding receptacle bore, these tongues or claws are first deflected radially inward and then, owing to their intrinsic elasticity, latch into the corresponding complementary geometries of the hub element when the required installation position is reached. The tongues are pressed inward in the process by the edge of the rotor centering bore. When the trigger plate/spring plate has reached its end position, the tongues click into the provided groove by way of their spring prestress and spread out. Withdrawal of the plate is now no longer possible Further details and features of the invention emerge from the following description in conjunction with the drawing, in which:

FIG. 1 is an axial sectional view illustrating the structure of an inventive timing adjustment device with a spring disk positively secured thereon;

FIG. 2 also shows an axial sectional view illustrating the installation position of an inventive timing adjustment device on a camshaft;

Figure 1:
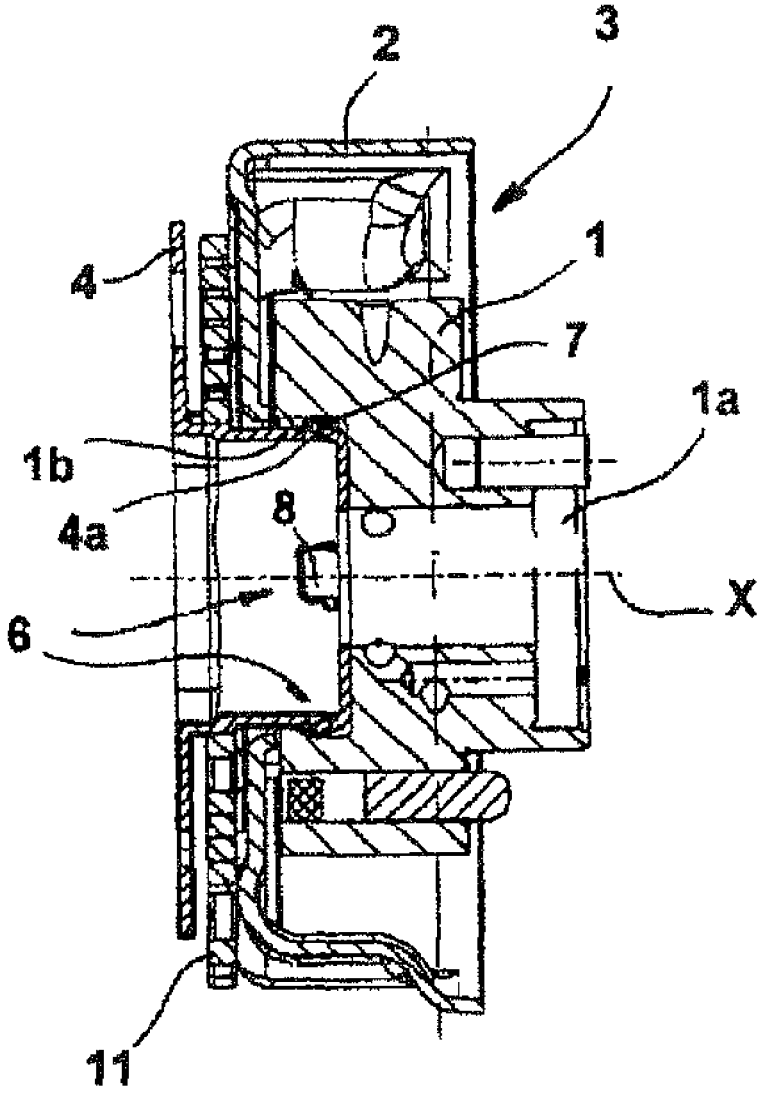

The timing adjustment device illustrated in FIG. 1 serves as such for setting, as required, the phase position of a camshaft of a valve drive with respect to the drive train of a camshaft. The timing adjustment device comprises a hub element 1 which has a seating region 1*a* which is provided for fitting onto an end section of a camshaft. An external housing element 2, which engages as such around the hub element 1 and can be pivoted with respect to the hub element 1 about a pivoting axis which is concentric with respect to the rotating axis X of the camshaft, is seated on said hub element 1.

An adjusting mechanism 3 (not illustrated in more structural detail) which serves here to bring about the pivoting of the external housing element 2 with respect to the hub element 1, is provided between said external housing element 2 and the hub element 1.

Figure 2:
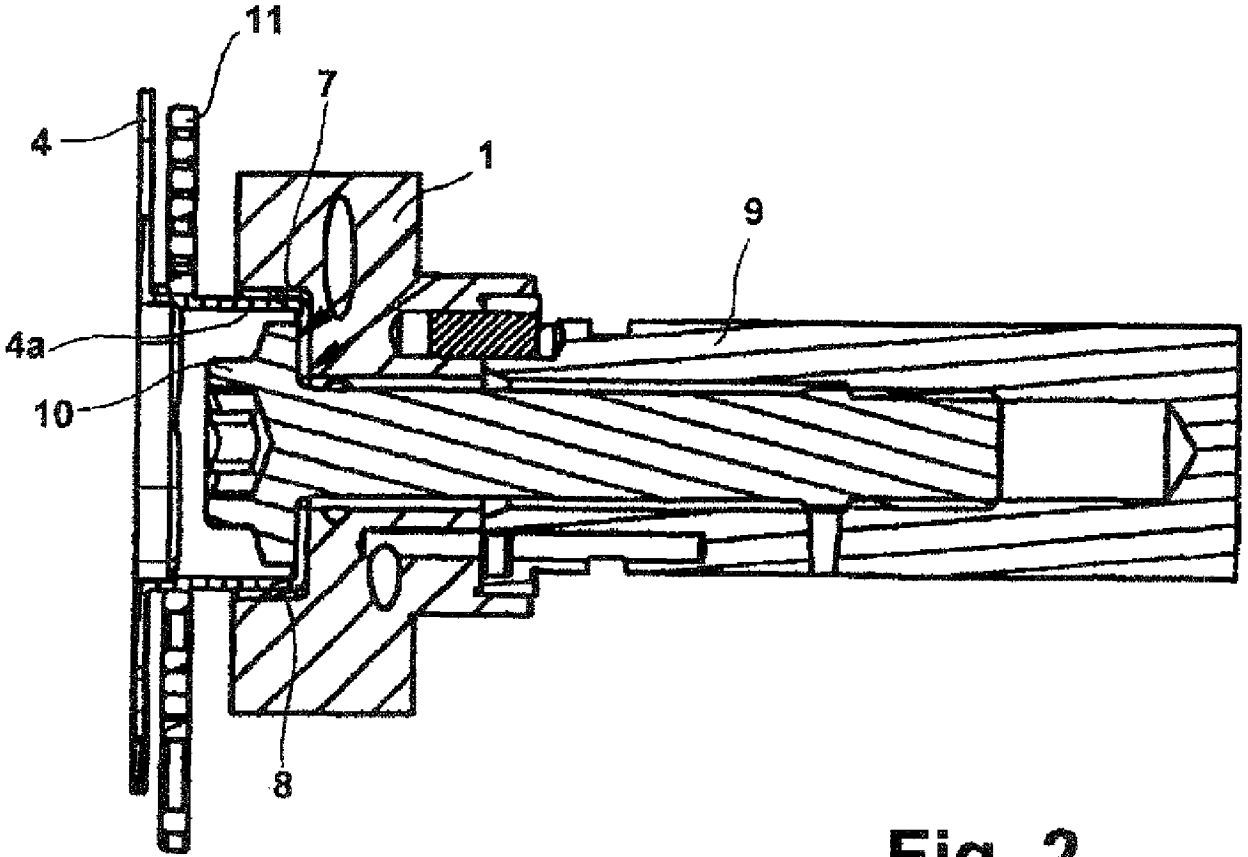

The timing adjustment device also comprises a disk element 4 which is clamped onto the hub element 1 by means of a central screw 5 of the camshaft (cf. FIG. 2). In this exemplary embodiment, this disk element 4 functions as a trigger wheel and as a carrier for a restoring spring 11 which is embodied here as a helical spring.

The timing adjustment device shown here is defined by the fact that an insertion section 4*a*, which can be inserted into a depression 1*b* formed in the hub element 1, is formed on the disk element 4, wherein at least one anchoring structure 6, by means of which the insertion section 4*a* can be anchored to a corresponding structure—here an internal circumferential groove 7—which is made available by the hub element 1, is formed in the region of the insertion section 4*a*.

As is apparent from this view, the anchoring structure 6 is embodied in such a way that it provides at least an axial safety device of the disk element 4 on the hub element 1. This anchoring structure can, as will be explained in more detail below, also be configured in such a way that it provides protection against rotation of the disk element 4 in the circumferential direction.

In this exemplary embodiment, the depression 1*b* is embodied as an essentially cylindrical bore in which the insertion section 4*a* of the disk element 4 is accommodated with a slight force fit. In the embodiment of the anchoring structure which is implemented here, said anchoring structure forms a plurality of projections which extend radially outward and are therefore undercut in conjunction with the circumferential groove 7 in the direction of extraction.

The anchoring structure can, as happens here, be embodied as an elastically deflectable rear-engagement structure, in particular with pawl sections, claw sections or lug sections which protrude radially outward. As an alternative to this, or else in combination with this measure, it is possible also to implement the anchoring structure 6 by means of local, plastic deformation of corresponding regions of the insertion section 4*a*. In the exemplary embodiment shown here, the rear-engagement structure 6 is formed by a plurality of pawls 8 which extend radially outward. The corresponding structure which interacts with this pawl 8 is, as already mentioned, embodied as a circumferential groove 7.

The illustration according to FIG. 2 shows only the hub element 1 which is fitted onto a camshaft 9, the disk element 4 which is additionally secured by means of the central screw 10 of the camshaft, and the restoring spring 11 which is seated on the disk element 4. The restoring spring 11 which is seated on this disk element 4 is embodied as a helical spring. In this exemplary embodiment also, the disk element 4 is anchored by pawls 8, which are formed on the insertion section 4*a* in the region thereof and extend radially outward, in a corresponding circumferential groove 7 or engagement pockets of the hub element 1.

Figure 3:
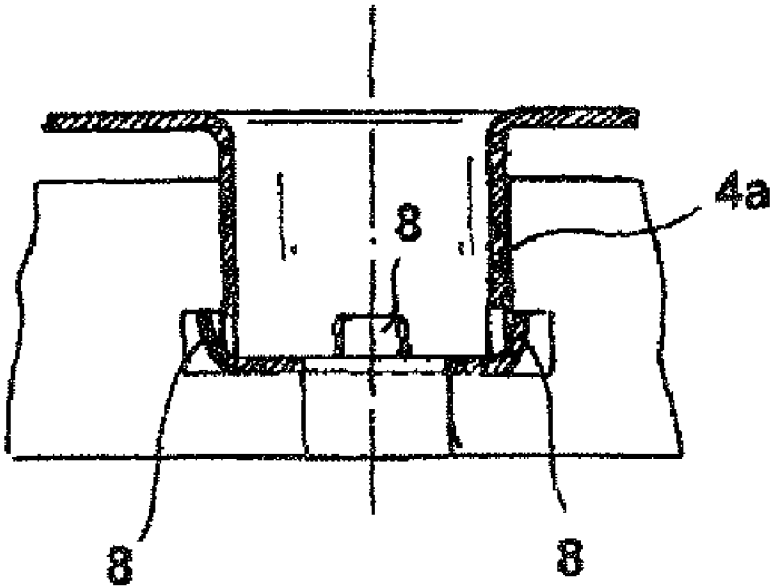
FIG. 3 shows a simplified sectional view illustrating the engagement state of an inventive disk element on the hub element of a timing adjustment device.

As is apparent in particular from the illustration according to FIG. 3, it is possible to provide, in the region of the insertion section 4*a*, a plurality of latching pawls 8 which follow one another in the circumferential direction. These latching pawls 8 may be configured in such a way that, owing to their intrinsic elasticity, they can enter into the latched state which is shown here and which provides an axial safety device. It is also possible to bring about the latched state shown here by plastic deformation, in particular by plastic bending-out of the pawl sections 8.

Figure 4:
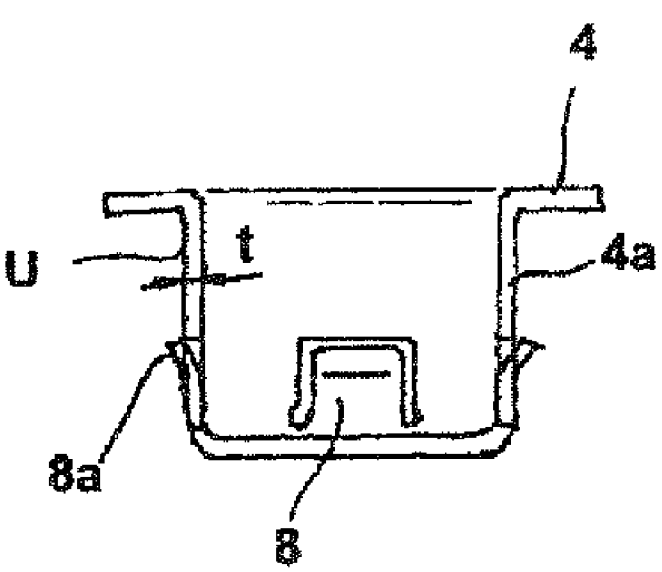
FIG. 4 is a sketch illustrating further the design of a preferred variant of the insertion section of the disk element.
Figure 5:
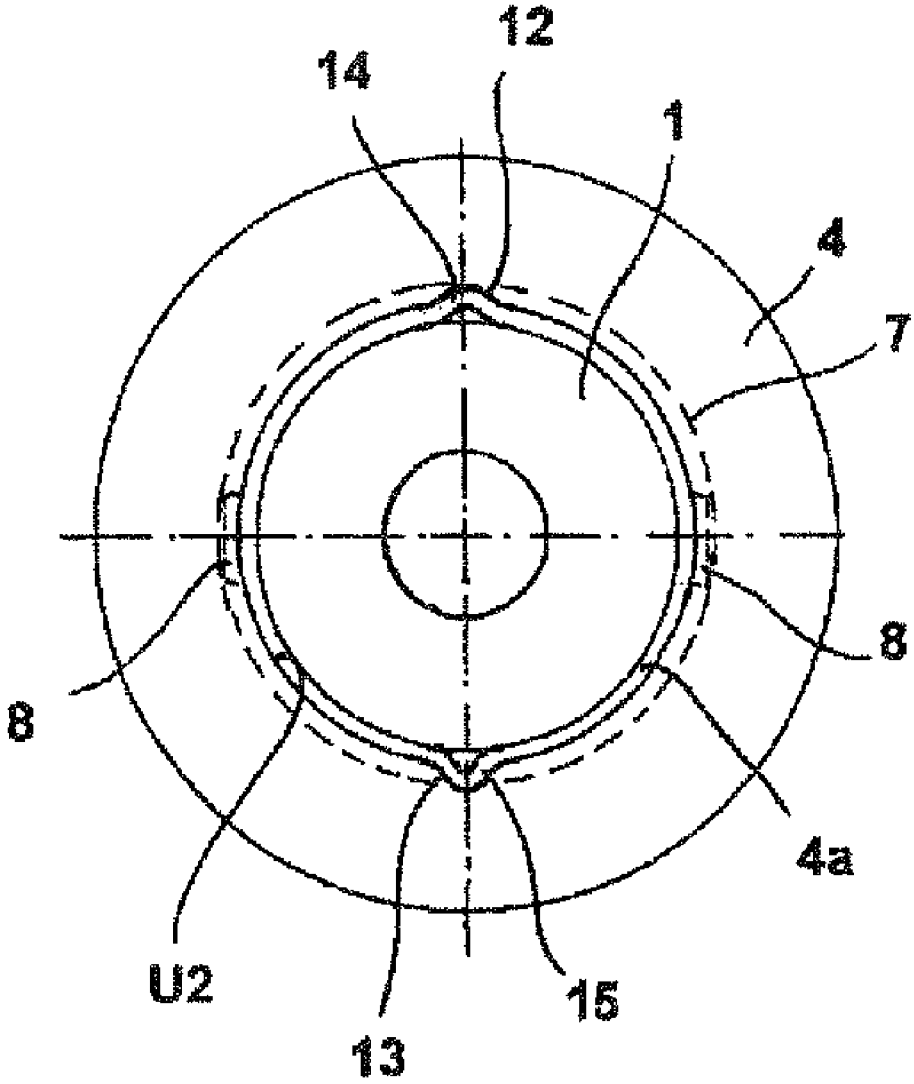
FIG. 5 shows a plan view illustrating further a means for protecting against rotation according to the invention.

FIG. 4 shows the design of the insertion section 4*a* of a disk element 4 in which the pawl edge section 8*a* which is made available by the pawls 8 and projects radially outward protrudes in the radial direction beyond the external circumferential wall U of the insertion section 4*a* to an extent, which corresponds at least to the wall thickness t of the material of the insertion section 4*a*. As is apparent from the illustration according to FIG. 5, it is possible, on the basis of the inventive concept, also to provide a means for protecting against rotation of the disk element 4 with respect to the hub element 1. For this purpose, it is possible, in particular, to form driver grooves 12, 13 in the region of the circumferential wall U2 accommodating the insertion section 4*a*. Driver lugs 14, 15 which are correspondingly formed on the insertion section 4*a* can engage in these driver grooves 12, 13. These driver lugs 14, 15, and in particular also the complementary geometries which are formed in the hub element 1 in order to provide protection against rotation can also have different cross-sectional geometries.

In the exemplary embodiment illustrated here, the securing structures which are provided for implementing protection of the disk element 4 against rotation are provided in combination with structures for axial safety, in a design such as may correspond, for example, to the exemplary embodiments described above. In particular, it is possible also to form a circumferential groove 7 in the hub element 1, with which circumferential groove 7 the radially projecting pawls 8 which are formed in the base region of the insertion section 4*a*, can engage.

Figure 6:
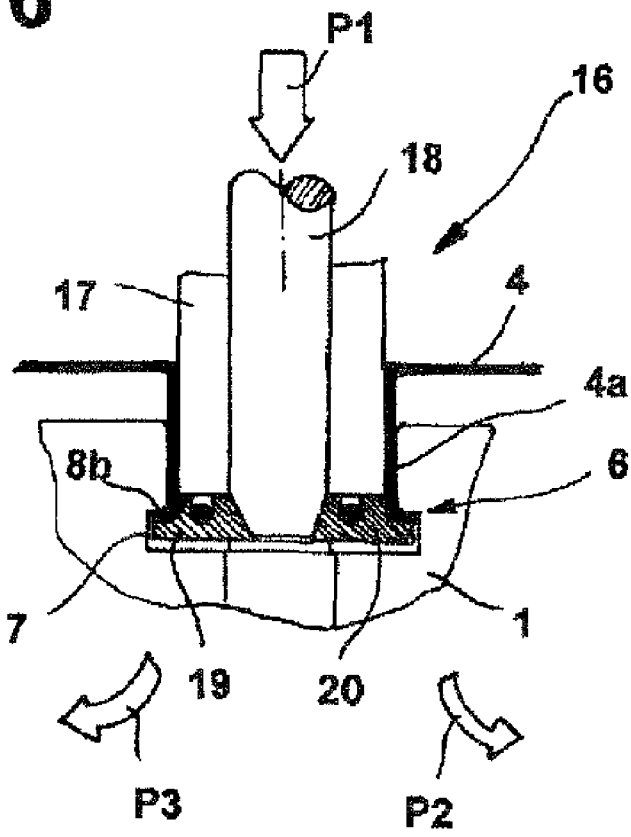
FIG. 6 is a schematic view illustrating a further inventive variant for at least providing protection against axial movement of a disk element on a hub element of a timing adjustment device.

FIG. 6 shows a further variant of a securing concept according to the invention for securing a disk element 4 to a hub element 1 of a timing adjustment device. In the exemplary embodiment shown here, the anchoring structures 6 which are provided for implementation of an axial safety device are provided by radial bending-out of tongue sections 8*b*. This radial bending-out of the tongue sections 8*b* can take place, for example, by means of a stamping tool 16 (indicated only by way of example in its basic design here). In the exemplary embodiment shown here, this stamping tool 16 comprises a stamping shell 17 and a stamping core 18, wherein disengagement slides 19, 20 can be activated by means of the stamping core 18. By means of these disengaging slides 19, 20 it becomes possible to fold radially outward the tongue sections 8*b* which have been cut free in advance in the insertion section 4*a*, as is apparent in this illustration, with the result that said tongue sections 8*b* fold into the circumferential groove 7 and therefore secure the disk element 4 in the axial direction in a positively locking fashion.

Figure 7:
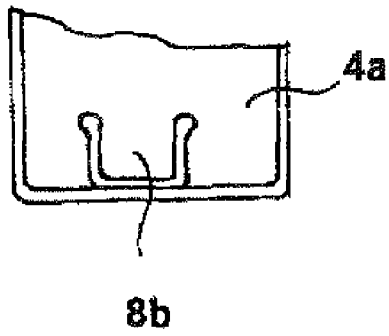
FIG. 7 is a sketch illustrating the configuration of the insertion section of the disk element before the insertion of the latter into the assigned receptacle bore region of the hub element.

FIG. 7 shows a preferred configuration of the insertion section 4*a*, which is equipped as such with cut-free tongue sections 8*b*.

As an alternative to the embodiment shown here for radially bending-out the tongue sections 8*b* by means of the disengagement slides described here, it is also possible to provide an elastomer structure on the stamping element, by means of which elastomer structure corresponding local radial widening of the tongue sections or else some other way of generating structures which protrude radially outward and thereby bring about positively locking securement is implemented on the insertion section 4*a* in the course of internal pressure shaping.

It is also possible to provide other kinds of engagement structures on the insert, which engagement structures are, for example, deformed or deflected by the head disk or a washer of the central screw and in the process bring about or support both protection against rotation and protection against extraction.

The invention claimed is:

1. A timing adjustment device for an internal combustion engine, comprising:

a hub element which has a seating region which is provided for fitting onto an end section of a camshaft;

an external housing element which engages as such around the hub element and is pivotable with respect to the hub element about a pivoting axis which is concentric with respect to a rotating axis of the camshaft;

an adjusting mechanism for bringing about pivoting of an external housing element with respect to the hub element; and a disk element which is clamped onto the hub element by means of a central screw of the camshaft, wherein an insertion section, which can be inserted into a depression formed in the hub element, is formed on the disk element, and in that at least one radially extending anchoring structure, by means of which the insertion section is anchored to a corresponding structure in a wall in the depression in the hub element, is formed in a region of the insertion section, said corresponding structure being a receptacle wherein said at least one radially extending anchoring structure latches.

2. The timing adjustment device of claim 1, wherein the anchoring structure provides an axial safety device.

3. The timing adjustment device of claim 1, wherein the anchoring structure provides protection against rotation.

4. The timing adjustment device of claim 1, wherein the depression is an essentially cylindrical bore.

5. The timing adjustment device of claim 1, wherein the anchoring structure is a radially extending projection which is undercut in an extraction direction.

6. The timing adjustment device of claim 1, wherein the anchoring structure is fabricated by local plastic deformation of the insertion section.

7. The timing adjustment device of claim 1, wherein the anchoring structure is an elastically deflectable rear-engagement structure.

8. The timing adjustment device of claim 7, wherein the rear-engagement structure is embodied as a radially protruding lug section.

9. The timing adjustment device of claim 7, wherein the rear-engagement structure is a radially extending pawl.

10. The timing adjustment device of claim 1, wherein the insertion section is a pot structure.

11. The timing adjustment device of claim 1, wherein the corresponding structure is a circumferential groove.

12. The timing adjustment device of claim 1, wherein the corresponding structure is a pocket or groove which is formed in a circumferential wall.

13. A method for fabricating a timing adjustment device for an internal combustion engine, in which a hub element and a disk element are coupled within the scope of a joining step by inserting an insertion section of the disk element into a receptacle bore in the hub element, wherein the disk element is anchored in a receptacle bore by forcing a section of a wall of the disk element outward in a radial direction into an anchoring recess which is in the receptacle bore of the hub clement, said section of a wall of the disk element being a radially extending anchoring structure which latches into said anchoring recess.

* * * * *